US009869524B2

(12) United States Patent
Bubits

(10) Patent No.: US 9,869,524 B2
(45) Date of Patent: Jan. 16, 2018

(54) SUPPORT FOR THE ARM OF A PISTOL SHOOTER

(71) Applicant: Wilhelm Bubits, Lutzmannsburg (AT)

(72) Inventor: Wilhelm Bubits, Lutzmannsburg (AT)

( * ) Notice: Subject to any disclaimer, the term of this patent is extended or adjusted under 35 U.S.C. 154(b) by 0 days.

(21) Appl. No.: 15/305,986

(22) PCT Filed: Apr. 23, 2015

(86) PCT No.: PCT/AT2015/050102
§ 371 (c)(1),
(2) Date: Oct. 21, 2016

(87) PCT Pub. No.: WO2015/161334
PCT Pub. Date: Oct. 29, 2015

(65) Prior Publication Data

US 2017/0045330 A1 Feb. 16, 2017

(30) Foreign Application Priority Data

Apr. 23, 2014 (AT) ..... A 290/2014

(51) Int. Cl.
*F41C 23/00* (2006.01)
*F41C 23/12* (2006.01)
*F41C 27/20* (2006.01)

(52) U.S. Cl.
CPC ..... *F41C 23/12* (2013.01); *F41C 27/20* (2013.01)

(58) Field of Classification Search
CPC ..... F41C 23/12; F41C 27/20
USPC ..... 42/72
See application file for complete search history.

(56) References Cited

U.S. PATENT DOCUMENTS 1,367,996 A * 2/1921 Sussman ..... F41A 9/53 42/69.01
2,145,078 A * 1/1939 Ferrel ..... F41C 23/00 42/72
2,400,349 A * 5/1946 Haberstump ..... F41C 23/04 42/72

(Continued)

FOREIGN PATENT DOCUMENTS

AT 410141 B 2/2003
CH 91378 A 11/1921

(Continued)

OTHER PUBLICATIONS

International Search Report from International Patent Application No. PCT/AT2015/050102, dated Sep. 4, 2015.

(Continued)

*Primary Examiner* — Samir Abdosh
(74) *Attorney, Agent, or Firm* — Greer, Burns & Crain, Ltd.

(57) ABSTRACT

A support for the arm of a shooter includes an elongated body having a first support surface for a shoulder region, and a handle for a hand at the front end. The handle forms a second support surface open to the front, for absorbing the recoil when shooting. The handle has a recess open to the front, into which fits the contour of the rear part of the grip of a portable firearm. The hand grasps both the handle and the grip of the portable firearm at the same time. The support optionally contains a wide variety of overmolded metal parts, such as a metal pin or knife blade.

7 Claims, 1 Drawing Sheet

(56) References Cited

U.S. PATENT DOCUMENTS 2,424,944 A * 7/1947 Patchett ..... F41C 23/04 42/72
2,683,948 A * 7/1954 Catron ..... F41C 23/12 42/72
3,256,632 A * 6/1966 Beretta ..... F41C 23/00 42/72
3,267,923 A * 8/1966 Ronci ..... F41C 23/10 124/84
3,609,902 A * 10/1971 Casull ..... F41C 23/12 42/62
4,291,482 A * 9/1981 Bresan ..... F41C 23/12 42/72
5,711,102 A * 1/1998 Plaster ..... F41C 23/00 42/71.01
6,318,014 B1 * 11/2001 Porter ..... F41C 23/12 42/71.01
7,673,413 B2 * 3/2010 Bentley ..... F41C 23/06 42/72
8,438,771 B1 * 5/2013 Boone ..... F41C 23/12 42/72
8,677,669 B1 * 3/2014 Vesligaj ..... F41C 23/04 42/71.02
9,631,893 B2 * 4/2017 Gilmer ..... F41C 27/22
2002/0174514 A1 * 11/2002 Vidal, Jr. ..... B25G 1/102 16/110.1
2005/0235546 A1 * 10/2005 Wonisch ..... F41A 3/12 42/75.01
2010/0154272 A1 * 6/2010 Lamm ..... F41C 23/12 42/72
2015/0068097 A1 * 3/2015 DenBleyker ..... F41C 23/12 42/94
2015/0323283 A1 * 11/2015 Hunkley ..... F41C 23/12 42/1.06
2016/0061558 A1 * 3/2016 Gilmer ..... F41C 27/22 42/71.02
2017/0082393 A1 * 3/2017 Gilmer ..... F41C 3/14

FOREIGN PATENT DOCUMENTS

DE 202012100648 U1 5/2013
GB 1912200465 A 0/1913

OTHER PUBLICATIONS

Written Opinion from International Patent Application No. PCT/AT2015/050102, dated Sep. 4, 2015.

* cited by examiner

SUPPORT FOR THE ARM OF A PISTOL SHOOTER

BACKGROUND

The invention relates to a support for the arm of a pistol shooter, with an elongated body, the rear end of which has a first support surface to lean on the shoulder region of the shooter.

Known stocks for pistols are removably mounted on the handle or on the housing of the respective pistol. Therefore, the pistol shooter has benefit of the advantages of a standard shotgun, for example, enhanced accuracy in firing. Such stocks are known, for example, from U.S. Pat. No. 8,438,771 or U.S. Pat. No. 4,291,482.

The U.S. Pat. No. 3,609,902 A describes a stock which is only suitable for revolvers, because its lower shaft strut covers the underside of the handle and thus cannot be used in pistols or some submachine guns. Moreover, the mentioned stock strut is extended in the shooting direction and additionally secured to the handle.

The AT 410 141 B describes a stock, the lower strut of which engages in an especially created guide of the handle, and the upper strut of which forms a contact surface for the handle. Since in use the hand of the shooter grasps only the handle of the pistol, the stability of the connection is limited by the bending stiffness of the lower strut.

All these stocks have the disadvantage that their assembly and disassembly require some skill or increased training effort. This can present a problem in the individual case. Furthermore, such stocks are to be fixed such that the return of the carriage is not obstructed. This affects either the grasp feeling (cf. U.S. Pat. No. 8,438,771) or requires constructional measures on the gun (cf. U.S. Pat. No. 4,291,482). These stocks are expedient in connection with a pistol.

It is therefore an object of the invention to provide a replacement for a stock according to the prior art, which can be used without loss of time and which is designed in such a manner that it does not need to be mounted on the pistol and may also be used for other purposes.

SUMMARY

Accordingly, the invention provides a support, which is characterized in the front end a handle for the hand of the shooter and a second support surface open to the front for absorbing the entire reactive force of the portable firearm are formed, the fixing taking place exclusively by the manual force of the shooter.

According to the invention, therefore the above-mentioned replacement is only a support between the hand of the shooter and his/her shoulder region. At the front end of the support, a handle for the hand of the shooter and a second support surface open to the front for absorbing the entire rearward reactive force of the pistol are arranged. That is to say, the shooter primarily holds the stock itself, which absorbs the recoil and thus in particular steadies the hand of the shooter. The hand of the shooter also grasps the grip of the gun and holds the two parts connected together at the same time.

In a preferred embodiment, the support or its body forms an upper and a lower strut in the front section, the front ends of which are connected to the handle, so that a clearance is given between the strut and the handle, the handle forming a recess open to the front, into which fits the contour of the rear part of the grip of the pistol or the portable firearm. The clearance accommodates the shooting hand of the shooter, so that he/she can grasp the handle with one hand together with the rear part of the grip accommodated by the handle. The grip and the support are held together by the hand of the shooter, so that no further connection element and no lock are required. If the support is no longer needed, all the shooter has to do is to open slightly his/her hand and the support will be released. The spatially curved handle, which is connected to the body of the support by means of the upper and lower struts is so rigid that it can accommodate the entire recoil.

Preferably, the support is a molded plastic part containing overmolded metal parts. These can serve the stiffening of the support or other purposes, such as rescue operations.

In an advantageous embodiment, the support contains a hard overmolded metal part protruding therefrom transversely to the longitudinal direction near the first support surface. The protruding metal part may be pointed and would also be suited to smash a glass pane or, in general, to be used as a hammer. Both could be used, for example, after a traffic accident during the salvage of vehicle occupants.

In another advantageous embodiment, the support accommodates—as an overmolded metal part—a knife blade protruding into a U-shaped slot of the support. The knife blade is suited to sever safety belts in the salvage of vehicle occupants. The edge of the blade, together with the slot, encloses an acute angle, to be able to perform a so-called pulling cut.

An advantageous further development consists in that the U-shaped slot is disposed in the longitudinal direction of the body of the support near its rear end and open to the front. Thus, the support can be grasped on the handle and the cutting can be performed by pulling on the handle. Due to the maximum distance between the handle and the blade, for example, intervention is also possible in the case of a burning vehicle.

It is also preferably provided that the U-shaped slot can be closed by a cover element guided therein, thus the knife blade being protected by means of the cover element. This cover element also protects the user against injuries and can be removed quickly. The cover element may also be configured as an alarm whistle.

The present support can be used for all portable firearms, i.e. also for revolvers, submachine guns and rifles of any kind. Knife blades or metal inserts may also be inserted in another form into the support, for example, bolted or pinned. Also, the support can be made of any materials.

BRIEF DESCRIPTION OF THE DRAWINGS

Below, the invention will be further discussed on the basis of preferred embodiments shown in the drawing, wherein.

DETAILED DESCRIPTION

Figure 1:
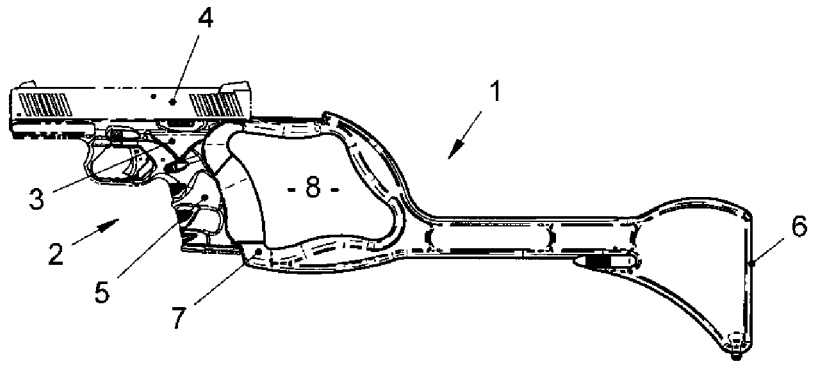
FIG. 1 is a side view of a pistol comprising the support according to the invention.

In FIG. 1 a support according to the invention is indicated by 1 on the whole, and furthermore a pistol 2 is shown by way of example. The visible parts of pistol 2 include a housing 3, a carriage 4 and a grip 5. The support 1 contains a first support surface 6 on its back end, which in use abuts on the shoulder region of a shooter, and a second support surface at its front end 7. Here, just as well as in the below, "front end" means the side facing the target and "rear end" means the side facing the shooter.

Figure 2:
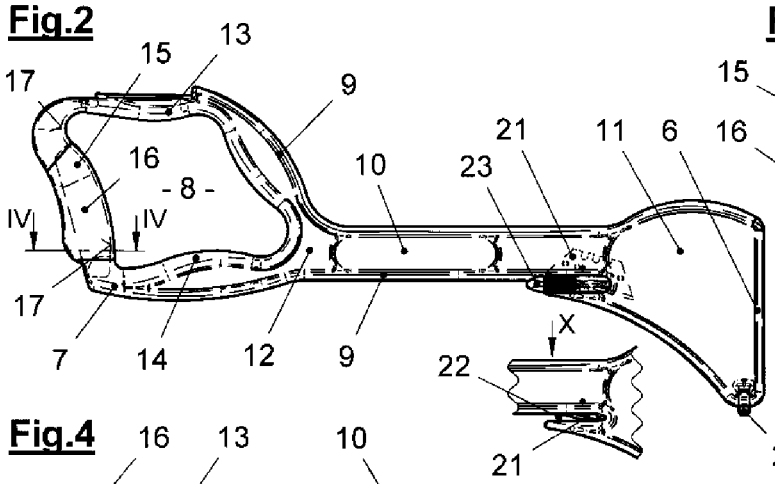
FIG. 2 is a side view of the support alone of FIG. 1.
Figure 3:
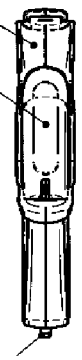
FIG. 3 is a front view of the support of FIGS. 1 and 2.

FIG. 2 and FIG. 3 show the support 1 in more detail. This support 1 essentially comprises an elongated body 10, a rear part 11 and a front part 12. In the illustrated embodiment, the elongated body 10 is a vertical plate in operating position, comprising edge stiffeners 9. The rear part 11 has the contour of a gun shaft and terminates in the support surface 6. In the front part 12, the body 10 branches into an upper strut 13 and a lower strut 14, the front ends of which merge into a handle 15 connecting them.

Figure 4:
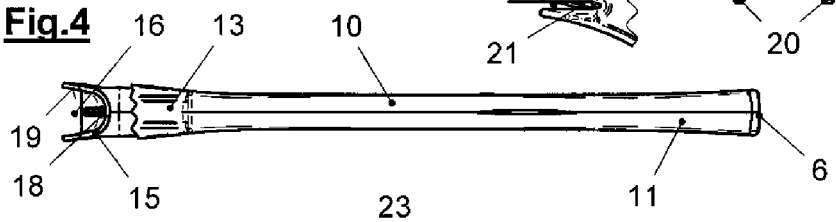
FIG. 4 is a top view of the support of FIGS. 1 and 2, partially cut in accordance with line IV-IV in FIG. 2.

With reference to FIG. 2 and FIG. 4 the handle 15 will now be described in more detail. For this, a cross-section IV-IV is laid through the handle 15 according to FIG. 2. The handle 15 is hollow and forms a recess 16 open to the front. In FIG. 2, the vertical contour of the recess 16 is shown in a dashed line and designated with 17, and it corresponds to the contour of the grip 5 of the pistol 2. In FIG. 4 the horizontal contour of the recess 16 is designated with 18 and corresponds to that of the grip 5 of the pistol 2. The contours 17, 18 form the above-mentioned second support surface. Thus, the grip 5 of the pistol 2 fits in the recess 16 in positive engagement, so that the recoil force of the shot is extensively guided into the handle 15 and thus into the support 1. Side walls 19 of the recess 16 laterally support the grip 5 of the pistol 2.

In use the hand of the shooter jointly grasps the handle 15 and the grip 5 of the pistol, the hand being partially in the open clearance 8 between the struts 13, 14 and the handle 15.

In FIG. 2 further details can be seen. The support 1 is preferably a molded part made of plastic with overmolded metal parts 20, 21, cf. also detail X of FIG. 2. In this case, a metal pin 20 is mounted in the vicinity of the first support surface 6 on the bottom side of the rear part 11 of the support 1. If the support 1 is held on the upper strut 13 or the lower strut 14, the metal pin 20 can be used to smash glass panes. Likewise, a metal part in the form of a hammer face (not shown) could be provided on the upper side of the rear part 11.

A metallic knife blade 21 is located at the junction of the body 10 of the support 1 in its rear part 11. The overmolded part of the knife blade 21 is drawn in dashed lines. Its oblique cutting edge extends in an elongated slot 22, which extends in the longitudinal direction of the body 10 and is open to the front. Safety belts can be cut in that the support 1 is held by the handle 15 and the former is pulled against the resistance of a belt. In FIG. 2 the slot 21 is closed with a cover part 23. The arrow X shows the detail without the cover part 23.

Figure 5:
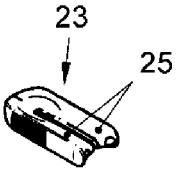
FIG. 5 is a detail of FIG. 2.

FIG. 5 finally shows the cover part 23 separately. It consists of two legs 25 interconnected at the front end, including therebetween a recess 24 for the knife blade 21. Furthermore, the cover part 23 may be configured as an alarm whistle or whistle, not illustrated in detail.

The invention claimed is:

1. A support for the arm of a shooter, comprising: an elongated body, the rear end of which terminates in a first support surface for the shoulder region of the shooter, wherein at the front end, a handle for the hand of the shooter and a second support surface open to the front for absorbing the entire reactive force of a pistol as a portable firearm, and a recess open to the front, into which fits the contour of the rear part of the grip of the portable firearm, are formed, the fixing taking place exclusively by the manual force of the shooter, wherein the elongated body comprises, to the front, an upper strut and a lower strut, front ends of the upper strut and the lower strut are connected to one another via the handle, so that a clearance is provided between the body, the upper and lower struts and the handle, and wherein the second support surface, together with the upper strut and the lower strut as well as with a rear part extending from the body and connecting the upper and lower struts, forms an integral closed-loop injection-molded plastic frame element where an underside of the grip of the pistol is freely accessible.

2. The support according to claim 1, wherein the injection-molded plastic frame element contains overmolded metal parts.

3. The support according to claim 2, further comprising a hard overmolded metal part projecting transversely to the longitudinal direction near the first support surface.

4. The support according to claim 1, further comprising, as an overmolded metal part, a knife blade projecting into a U-shaped slot.

5. The support according to claim 4, wherein the U-shaped slot extends in a longitudinal direction and is open to the front.

6. The support according to claim 5, wherein the U-shaped slot is closeable by a cover element guided therein.

7. The support according to claim 6, wherein the cover element is adapted as an alarm whistle.

* * * * *